United States Patent [19]

Kochanowski

[11] Patent Number: 5,074,766

[45] Date of Patent: Dec. 24, 1991

[54] FUEL INJECTION PUMP FOR AN INTERNAL COMBUSTION ENGINE HAVING PRE-INJECTION AND MAIN INJECTION OF FUEL

[75] Inventor: Hans A. Kochanowski, Ruhstorf, Fed. Rep. of Germany

[73] Assignee: Motorenfabrik Hatz GmbH & Co. KG, Ruhstorf, Fed. Rep. of Germany

[21] Appl. No.: 314,139

[22] Filed: Feb. 22, 1989

[30] Foreign Application Priority Data

Apr. 18, 1988 [DE] Fed. Rep. of Germany ..... 3812867

[51] Int. Cl.[5] ..... F04B 7/04; F02B 3/00

[52] U.S. Cl. ..... 417/496; 417/499; 123/299

[58] Field of Search ..... 417/494, 499; 123/299, 123/300, 447, 503, 506

[56] References Cited

U.S. PATENT DOCUMENTS 2,871,796 2/1959 Dreisin et al. ..... 417/499

FOREIGN PATENT DOCUMENTS 585014 9/1933 Fed. Rep. of Germany ..... 417/494

916605 8/1954 Fed. Rep. of Germany ..... 417/494

316691 4/1934 Italy ..... 417/494

*Primary Examiner*—Leonard E. Smith

*Assistant Examiner*—John A. Savid, III

*Attorney, Agent, or Firm*—Flynn, Thiel, Boutell & Tanis

[57] ABSTRACT

A fuel injection pump for an internal combustion engine has at least one pump piston movably disposed in a piston sleeve in a pump housing. The piston includes a first arrangement operable during a stroke in a suction direction for drawing fuel from a suction side of the pump. The piston further includes a second arrangement operable during a stroke in a delivery direction for first cutting off a connection to the suction side of the pump and then initiating delivery from a working chamber into a pressure line. The piston and piston sleeve are provided with a control arrangement which divides the fuel injection into pre-injection and main injection phases. At least one pressure limiting arrangement is provided and is associated with the working chamber. The limiting arrangement is operable during the pre-injection phase when a predetermined engine speed is reached for maintaining the pressure in the working chamber and in the pressure line at a predetermined level.

4 Claims, 1 Drawing Sheet

FUEL INJECTION PUMP FOR AN INTERNAL COMBUSTION ENGINE HAVING PRE-INJECTION AND MAIN INJECTION OF FUEL

FIELD OF THE INVENTION

The present invention relates to a fuel injection pump for an internal combustion engine having at least one pump piston which is movably disposed in a piston sleeve fitted tightly in a pump housing and, more particularly, to a pump which, during its stroke in a suction direction, draws fuel from a suction side of the injection pump and, during its stroke in a delivery direction, first cuts off the connection to the suction side and then initiates delivery from a working chamber into a pressure line leading to an injection nozzle, and in which both the piston and the piston sleeve are provided with control arrangements which divide the overall fuel injection into pre-injection and main injection phases.

BACKGROUND OF THE INVENTION

In such pumps, it has been shown that, despite predetermined relative measuring of the control arrangements which define the pre-injection fuel quantity during operation, a desired pre-injection fuel quantity which remains constant throughout the whole engine speed range is not achieved. It is apparent that pre-delivery and post-delivery effects in the pump are responsible for an undesirable increase in line pressure on the high-pressure side of the pump, and hence in the pre-injected fuel quantity, as operational speed increases.

The present invention seeks to eliminate this disadvantage and to keep the pre-injection fuel quantity at a substantially constant level for the whole range of speed or operating states.

SUMMARY OF THE INVENTION

According to the present invention there is provided a fuel injection pump for an internal combustion engine, having at least one pump piston movably disposed in a piston sleeve fitted tightly in a pump housing, which piston, during its stroke in the suction direction, draws fuel from the suction side of the pump and, during its stroke in the delivery direction, first cuts off the connection to the suction side and then initiates delivery from the working chamber into a pressure line leading to an injection nozzle, both the piston and the piston sleeve being provided with control arrangements which divide the fuel injection into pre-injection and main injection phases. At least one pressure limiting arrangement which is associated with the working chamber acts, when a predetermined engine speed is reached, during the pre-injection phase, so as to maintain the pressure in the working chamber and in the pressure line at a predetermined level, the pressure limiting arrangement remaining inoperative during the main injection phase.

Preferably, the pressure limiting arrangement is in the form of a spring-biased valve which, when a predetermined pressure level is reached, opens against the resilience of the spring so as to open an overflow path from the working chamber to the suction side of the pump. The valve may comprise a ball valve or a flatseat valve located in the pump piston or in a housing part surrounding the working chamber.

A further advantageous embodiment of the invention is obtained if the pressure limiting arrangement is in the form of a yieldable piston, one end of which is biased by a spring and the other end of which projects into a compensating chamber, which chamber communicates with the working chamber. When a predetermined pressure level is reached, the yieldable piston is moved in its guide bore against the resilience of the spring, such that the effective volume of the compensating chamber increases and pressure limitation is effected in the working chamber and in the pressure line. Advantageously, the guide bore for the yieldable piston may be located in the piston sleeve of the pump and connected with the working chamber through a recess in the end face of the housing part which surrounds the working chamber and which is seated on the piston sleeve.

BRIEF DESCRIPTION OF THE DRAWINGS

The invention is described further hereinafter, by way of example only, with reference to the accompanying drawings, in which.

DETAILED DESCRIPTION

Figure 3:
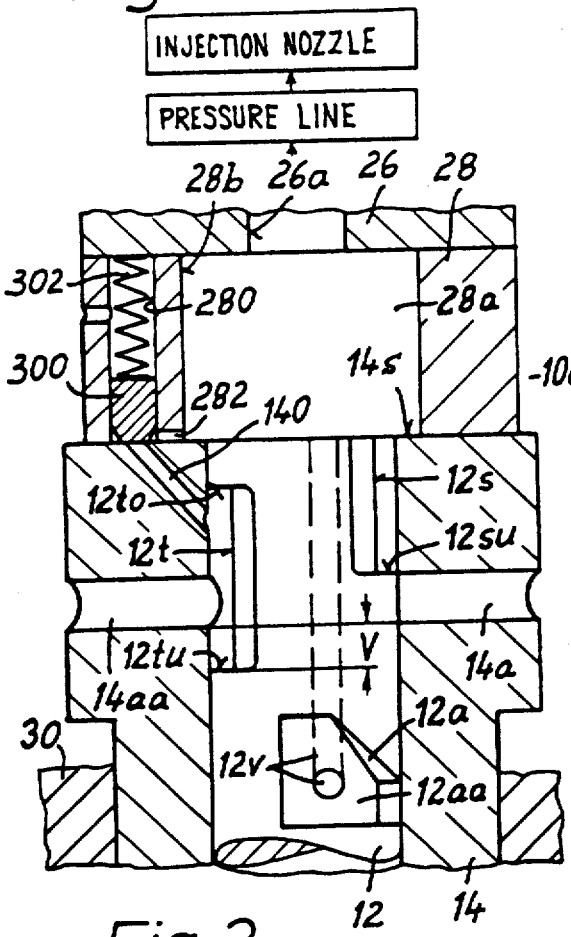

The embodiments of the invention described below are improvements to the injection pump for pre-injection and main injection of fuel described in the published German Patent Application No. 38 09 700, corresponding to U.S. Ser. No. 07/314 138 filed Feb. 22, 1989. In that pump, as shown in FIG. 3, a piston 12 is movably located in a piston sleeve 14, which is fitted tightly in a pump housing 30. An annular disc 26 and an annular intermediate member 28 are retained together with a pressure valve housing (not shown) in the pump housing 30 by a threaded connecting nipple (not shown), the intermediate member 28 being seated on the end face of the piston sleeve 14. The intermediate member 28 has an inside wall **28*b* which encloses and defines a pump working chamber 28*a*. A central bore 26*a* of the annular disc 26 provides communication between the working chamber 28*a*** and a pressure valve (not shown), wherein a pressure line, which can be connected to the threaded nipple, leads to an injection nozzle.

In the pump disclosed in German Application No. 38 09 700, the pre-injection and main injection fuel quantities are controlled by way of the suction bores **14*a* and 14*aa* of the piston sleeve 14 and the annular edge 14*s* on the end face of the piston sleeve 14, in cooperation with the pump piston 12. The cooperating structure of the pump piston 12 includes diametrically opposite radial recesses 12*s* and 12*t* having respective radial edges 12*su* and 12*to*, 12*tu*, an oblique control edge 12*a* in a recess 12*aa* and a connecting bore 12*v***.

Figure 2:
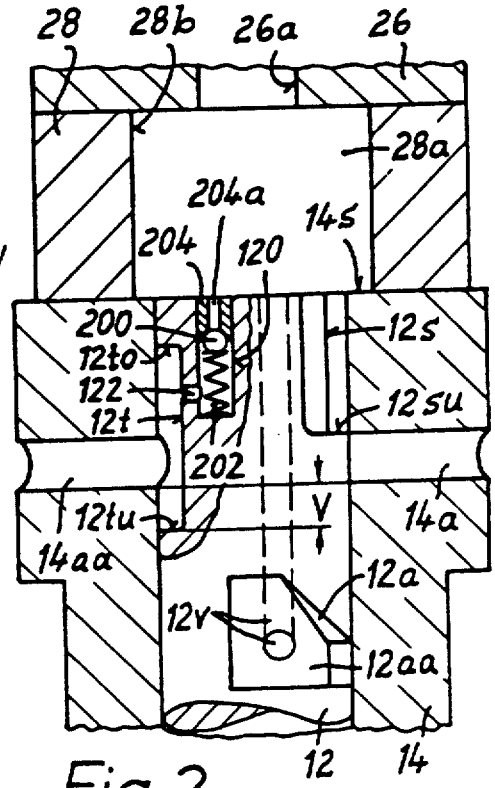
FIGS. 2 to 4 illustrate variations of a pressure limiting arrangement according to various embodiments of the present invention.

The above-mentioned published German Patent Application describes in detail that, as shown in FIG. 2, the pre-injection stroke V commences as soon as the lower radial edge **12*su* slides past the suction bore 14*a* and prevents fuel from flowing back during the delivery stroke of the piston 12, from the working chamber 28*a* to the suction side 10*a* of the pump. Pre-injection is terminated as soon as the upper radial edge 12*to* slides past the annular edge 14*s* and opens a return flow line for fuel from the working chamber 28*a* to the suction side 10*a*, via the recess 12*t* and suction bore 14*aa***.

Figure 1:
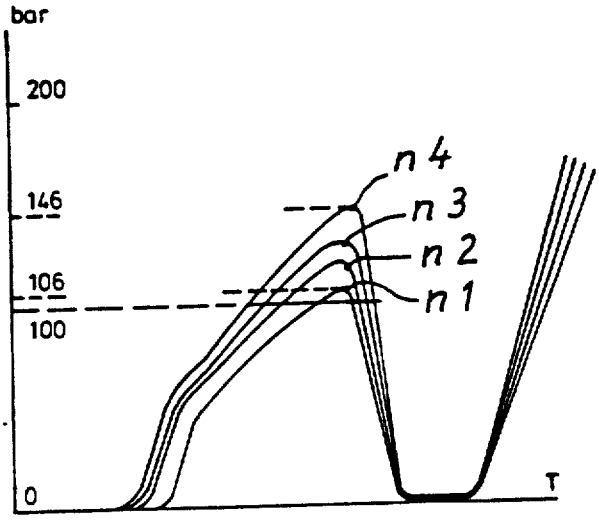
FIG. 1 is a schematic representation of the fuel pressure levels of a fuel injection pump during the pre-injection phase.

The control phases of the subsequent main injection of fuel, which commences with a renewed increase in pressure as illustrated on the right-hand side of FIG. 1, will not be dealt with here since it would not further contribute to the understanding of the present invention.

In pumps having pre-injection, it has been shown that the pressure level, and hence the pre-injection fuel quantity, both in and beyond the pump usually increases considerably with increasing engine speed. FIG. 1, for example, is a schematic representation of the variation of pressure with time at several engine speeds, which pressure is measured at a location on the nozzle side of the pump during pre-injection in a comparable pump embodiment. The four curves, n1, n2, n3, n4 show the pressure development in the same pump at four different engine speeds, namely 1,500, 1,800, 2,000, and 2,300 revolutions per minute. It can clearly be seen that the maximum pressure level is not the same for all four cases. Rather, pressure increases from n1 to n4 by about 40 bar. A corresponding increase is thus also obtained in the pre-injection fuel quantity, which is particularly disadvantageous since it greatly interferes with engine operation at varying engine speeds.

Turning now to the improvements of the present invention, the following measures are provided in order to achieve a constant, or at least a substantially constant, maximum pressure level with respect to engine speed (e.g. about 100 bar, as shown by the dotted line in FIG. 1) in the working chamber 28a and the pressure line during pre-injection, and thus also to provide a substantially constant pre-injection fuel quantity.

As shown in FIG. 2, a bore 120, parallel to the longitudinal axis of the piston 12, and located therein, communicates by way of a transverse bore 122 with the radial recess 12t. A ball valve 200 having a biasing spring 202 is inserted in the bore 120, the ball valve being seated on a hemispherical valve seat of an insert sleeve 204 which has an axial bore 204a and is pressed into the piston 12. The resilience of the spring 202 is such that it retains the valve ball 200 against the seat and hence maintains the valve 200, 204 closed even when pressure of up to 100 bar prevails in the working chamber 28a. However, as soon as the pressure exceeds the predetermined level, the valve 200, 204 opens and a small portion of the fuel flows, as an excess quantity, out of the working chamber 28a by way of the axial bore 204a, the bore 120, the transverse bore 122, the radial recess 12t and the suction bore 14aa, back to the suction side 10a. In this way, the pressure in the working chamber 28a is kept at the desired maximum level and an unwanted increase in the pre-injection fuel quantity with increasing engine speed is avoided.

The subsequent main injection occurs when the radial edge 12tu slides past the bore 14aa, which bore is then closed off so that, in this phase, the overflow path comprising the valve 200, 204 is closed and the pressure limiting valve 200, 204 thus remains inoperative.

In a second embodiment, illustrated in FIG. 3, the valve may be disposed in the intermediate member 28, as an alternative to being seated in the piston 12. In such a case, a guide bore 280, disposed parallel to the longitudinal axis of the piston 12, is provided in the part 28 and has disposed therein a flat-seat valve 300 along with a biasing spring 302. The valve 300 is seated on the end face of the piston sleeve 14 and when so seated, closes off a connecting line 140 in the piston sleeve 14, which line leads to the radial recess 12t. A transverse groove 282 provides communication between the working chamber 28a and the guide bore 280 of the valve 300. In this embodiment, when a predetermined pressure level is reached in the chamber 28a, the valve 300, 302 opens the overflow path which effects pressure limitation. Main injection occurs when the lower radial edge 12tu slides past the bore 14aa which is thus closed off, and so the valve 300, 302 remains inoperative.

Figure 4:
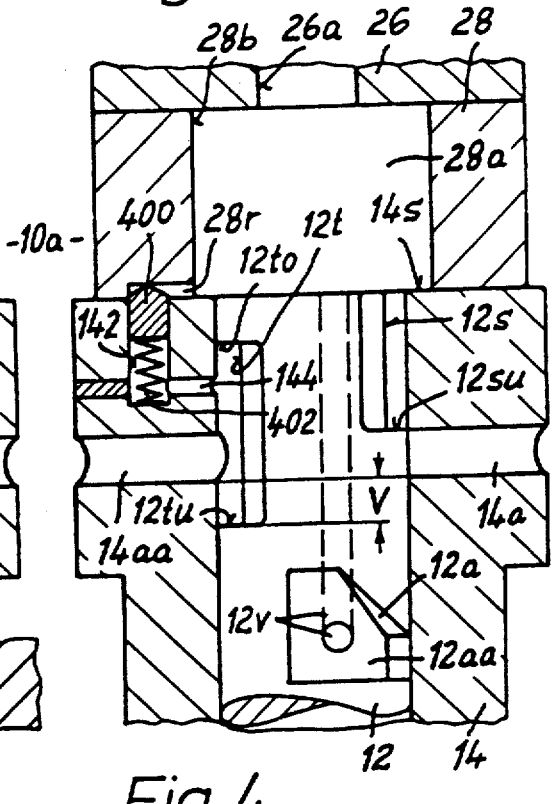

FIG. 4 illustrates yet another embodiment. A guide bore 142 is disposed in the piston sleeve 14 parallel to the longitudinal axis of the piston 12. A yieldable piston 400 is disposed in the guide bore 142 along with a biasing spring 402. A radial recess 28r on the lower end face of the part 28 provides for communication between the working chamber 28a and the guide bore 142. A radial transverse bore 144 connects the chamber cf the guide bore 142, below the yieldable piston 400, to the radial recess 12t, and hence also to the suction side 10a of the injection pump. In the illustrated embodiment, the yieldable piston 400 moves back against the resilience of the spring 402 in the guide bore 142 when a predetermined pressure level is reached in the working chamber 28a. The effective volume of the working chamber 28a is thus increased. As a result pressure is reduced or limited in the working chamber 28a as engine speed increases, and hence the same pressure limitation is ensured as in the embodiments illustrated in FIGS. 2 and 3. Thus, the radial recess 28r and the guide bore 142 together form a compensating chamber of variable volume which volume is increased, due to movement of the piston 400 against the spring 402 in the guide bore 142, as necessary to compensate for excessive pressure in the working chamber 28a.

Although particular preferred embodiments of the invention have been disclosed in detail for illustrative purposes, it will be recognized that variations or modifications of the disclosed apparatus, including the rearrangement of parts, lie within the scope of the present invention.

It should be noted in particular that the pressure limitation arrangement may comprise features different from those illustrated and may be adapted to given operating conditions in each case. It would also be practical to use the pressure limitation arrangement in a similar way in pump types other than those illustrated in the above-mentioned published German Patent Application.

The embodiments of the invention in which an exclusive property or privilege is claimed are defined as follows:

1. A fuel injection pump for an internal combustion engine, having at least one pump piston movably disposed in a piston sleeve fitted tightly in a pump housing, said piston including first means operable during a stroke in a suction direction for drawing fuel from a suction side of the pump, said piston including second means operable during a stroke in a delivery direction for first cutting off a connection to the suction side and then initiating delivery from a working chamber into a pressure line leading to an injection nozzle, both the piston and the piston sleeve being provided with control means which divide the fuel injection into pre-injection and main injection phases, and at least one pressure limiting means associated with the working chamber and operable during the pre-injection phase when a predetermined engine speed is reached for maintaining the pressure in the working chamber and in the pressure line at a predetermined level, said pressure limiting means remaining inoperative during the main injection phase, said pressure limiting means including resilient valve means operable when the predetermined pressure level is reached for opening against said resilient and providing an overflow path from the working chamber to the suction side of the pump, said resilient valve means including a spring-biased valve disposed in the pump piston.

2. A pump as in claim 1, wherein the valve is a ball valve.

3. A fuel injection pump for an internal combustion engine, having at least one pump piston movably disposed in a piston sleeve fitted tightly in a pump housing, said piston including first means operable during a stroke in a suction direction for drawing fuel from a suction side of the pump, said piston including second means operable during a stroke in a delivery direction for first cutting off a connection to the suction side and then initiating delivery from a working chamber into a pressure line leading to an injection nozzle, both the piston and the piston sleeve being provided with control means which divide the fuel injection into pre-injection and main injection phases, and at least one pressure limiting means associated with the working chamber and operable during the pre-injection phase when a predetermined engine speed is reached for maintaining the pressure in the working chamber and in the pressure line at a predetermined level, said pressure limiting means remaining inoperative during the main injection phase, said pressure limiting means comprising a compensating chamber, which chamber communicates with the working chamber, and compensating means operable when the predetermined pressure level is reached for increasing the effective volume of the compensating chamber and limiting the pressure in the working chamber and in the pressure line, said compensating means including a yieldable piston having one end biased by a spring and the other end projecting into said compensating chamber, said piston being disposed in a guide bore and movable therein against the resilience of said spring.

4. A pump as claimed in claim 3, wherein the guide bore for the yieldable piston is located in the piston sleeve of the pump, and is connected with the working chamber through a recess in an end face of a housing part which surrounds the working chamber and which is seated on the piston sleeve.

* * * * *